United States Patent [19]

Hill et al.

[11] Patent Number: 4,499,945

[45] Date of Patent: Feb. 19, 1985

[54] SILANE-PROPANE IGNITOR/BURNER

[75] Inventors: Richard W. Hill; Dewey F. Skinner; Charles B. Thorsness, all of Livermore, Calif.

[73] Assignee: The United States of America as represented by the United States Department of Energy, Washington, D.C.

[21] Appl. No.: 498,438

[22] Filed: May 26, 1983

[51] Int. Cl.[3] ..... E21B 29/02; E21B 36/02

[52] U.S. Cl. ..... 166/50; 166/55.1; 166/59; 166/91; 166/260

[58] Field of Search ..... 166/50, 53, 55, 55.1, 166/59, 91, 95, 256, 259, 260, 297

[56] References Cited

U.S. PATENT DOCUMENTS

| | | | |
|---|---|---|---|
| 2,786,660 | 3/1957 | Alleman | 166/50 X |
| 3,017,168 | 1/1962 | Carr | 166/256 X |
| 3,179,169 | 4/1965 | Cline et al. | 166/260 |
| 3,254,721 | 6/1966 | Smith | 166/59 |
| 3,563,606 | 2/1971 | Sears | 166/259 X |
| 3,774,682 | 11/1973 | Bousaid et al. | 166/260 |
| 4,027,917 | 6/1977 | Bartel et al. | 166/260 |
| 4,245,701 | 1/1981 | Chambers | 166/260 X |
| 4,301,866 | 11/1981 | Burton et al. | 166/260 |
| 4,334,579 | 6/1982 | Gregg | 166/256 |

OTHER PUBLICATIONS

"The Controlled Retracting Injection Point (Crip) System: A Modified Stream Method for in situ Coal Gasification" by R. W. Hill and M. J. Shannon, UCR-L-85852.

*Primary Examiner*—George A. Suchfield

*Attorney, Agent, or Firm*—Henry P. Sartorio; Harold M. Dixon

[57] ABSTRACT

A silane propane burner for an underground coal gasification process which is used to ignite the coal and to controllably retract the injection point by cutting the injection pipe. A narrow tube with a burner tip is positioned in the injection pipe through which an oxidant (oxygen or air) is flowed. A charge of silane followed by a supply of fuel, such as propane, is flowed through the tube. The silane spontaneously ignites on contact with oxygen and burns the propane fuel.

8 Claims, 2 Drawing Figures

SILANE-PROPANE IGNITOR/BURNER

The United States Government has rights in this invention pursuant to Contract No. W-7405-ENG-48 between the U.S. Department of Energy and the University of California, for the operation of Lawrence Livermore National Laboratory.

BACKGROUND OF THE INVENTION

The invention relates to underground coal gasification and, more particularly, to a controlled retracting injection point system for in situ coal gasification.

Coal gasification methods have been used to produce combustible fuel from coal. When coal is heated in the presence of oxygen and steam it gives off a mixture of combustible gases which can be refined and purified and used as fuel. These product gases are environmentally more advantageous than coal since they burn cleaner, producing less air pollution, and are easier to transport. Above ground gasification processes are available but require expensive and difficult mining and transportation before surface processing.

It is more advantageous to gasify coal in situ by chemically reacting the coal underground to produce combustible product gases. Boreholes are drilled into the seam, and the coal is ignited, and oxidizing gas and steam are pumped down through an injecting well to support combustion in the underground reaction zone. The coal is partially oxidized producing gas of low or medium heating value. The hot product gases flow through a channel in the coal seam and are removed through a production or recovery well. For the process to occur a permeable path through the coal must be provided between the injection and production well to permit the high volume gas flow that is required.

Linking methods include countercurrent or reverse combustion, directional drilling and electrolinking. Countercurrent or reverse combustion linking is the most commonly used technique for enhancing the permeability of the coal bed. Air is forced into the injection well and flows to the production well through natural fissures in the coal bed. The coal at the bottom of the production well is ignited and a burn front is drawn by conduction to the source of oxygen, charring a narrow channel countercurrent to the flow of air. The directional drilling method produces a gasification channel through the coal by drilling along a coal seam at varying angles and intersecting the production and injection wells. The link is established at the bottom of the coal seam so that as the gasification process progresses coal falls into the void producing coal rubble with a large surface area for coal-gas reactions.

In practice, the underground coal gasification process is subject to various problems that may make it difficult to maintain and control an efficient long-term operation. A major problem is the need to move the injection point, where the combustion supporting air or oxygen from the surface is fed into a coal seam, to new areas of unburned coal as the burn progresses. With the standard arrangement of injection well, linking channel, and production well, the burn zone geometry is constantly changing as the cavity grows around the injection well toward the production well and up to the roof rock. Roof collapse fills the cavity with inert material, providing an opportunity for oxygen to bypass the reaction zone and oxidize the product gas lowering its quality. Heat loss increases as more and more roof material is exposed with consequent lowering of the heating value of the product gas. Vertical injection wells are subject to an extremely harsh environment of high temperatures, corrosive gases and massive mechanical forces from rock motion.

Experiments conducted at Hoe Creek indicate that maintaining the injection point at a low position in the coal seam is essential for obtaining good gas quality and high resource recovery. However, maintaining a low injection point is very difficult with a vertical injection well. Accordingly, a system is desired which provides a more constant burn geometry and a seam bottom injection point.

U.S. Pat. No. 4,334,579 to Gregg issued June 15, 1982 describes methods for coal gasification, including several embodiments implemented from the coal face utilizing a withdrawable or degradable injection pipe, in which the injection point is moved sequentially around the perimeter of a coal removal area to sweep out the area and maintain gas-coal contact.

U.S. Pat. No. 3,563,606 to Sears issued Feb. 16, 1971 discloses a method of coal gasification utilizing a withdrawable inlet pipe.

It is an object of the invention to provide method and apparatus for the controlled retraction of the injection point in an underground coal gasification process.

It is another object of the invention to provide method and apparatus for the controlled destruction of the injection pipe in an underground gasification process to controllably move the injection point.

It is another object of the invention to provide a method and apparatus for igniting coal in an underground coal gasification process.

SUMMARY OF THE INVENTION

The invention is a silane-propane burner which is used to ignite coal at the end of an injection pipe or to cut the injection pipe itself to controllably move the injection point during the gasification process.

The silane-propane burner comprises a narrow tube having a burner tip and a connected gas supply system. The silane burner performs two functions, first it is positioned at the end of the injection pipe to ignite the coal and then it is moved controllably to a sequence of positions inside the injection pipe to cut the injection pipe to provide new injection points. The silane burner is a chemical system which is an improvement over the electrical resistance heater used to ignite coal and also provides repeated ignitions to implement the controlled retracting injection point method. The silane burner allows better control of the gasification process by allowing the choice of the optimum time and distance for moving the injection point to maximize the gasification process. The silane ignitor also has applications in other in situ recovery processes besides coal gasification, for example, in the tertiary recovery of crude oil.

DETAILED DESCRIPTION OF THE PREFERRED EMBODIMENTS

Figure 1:
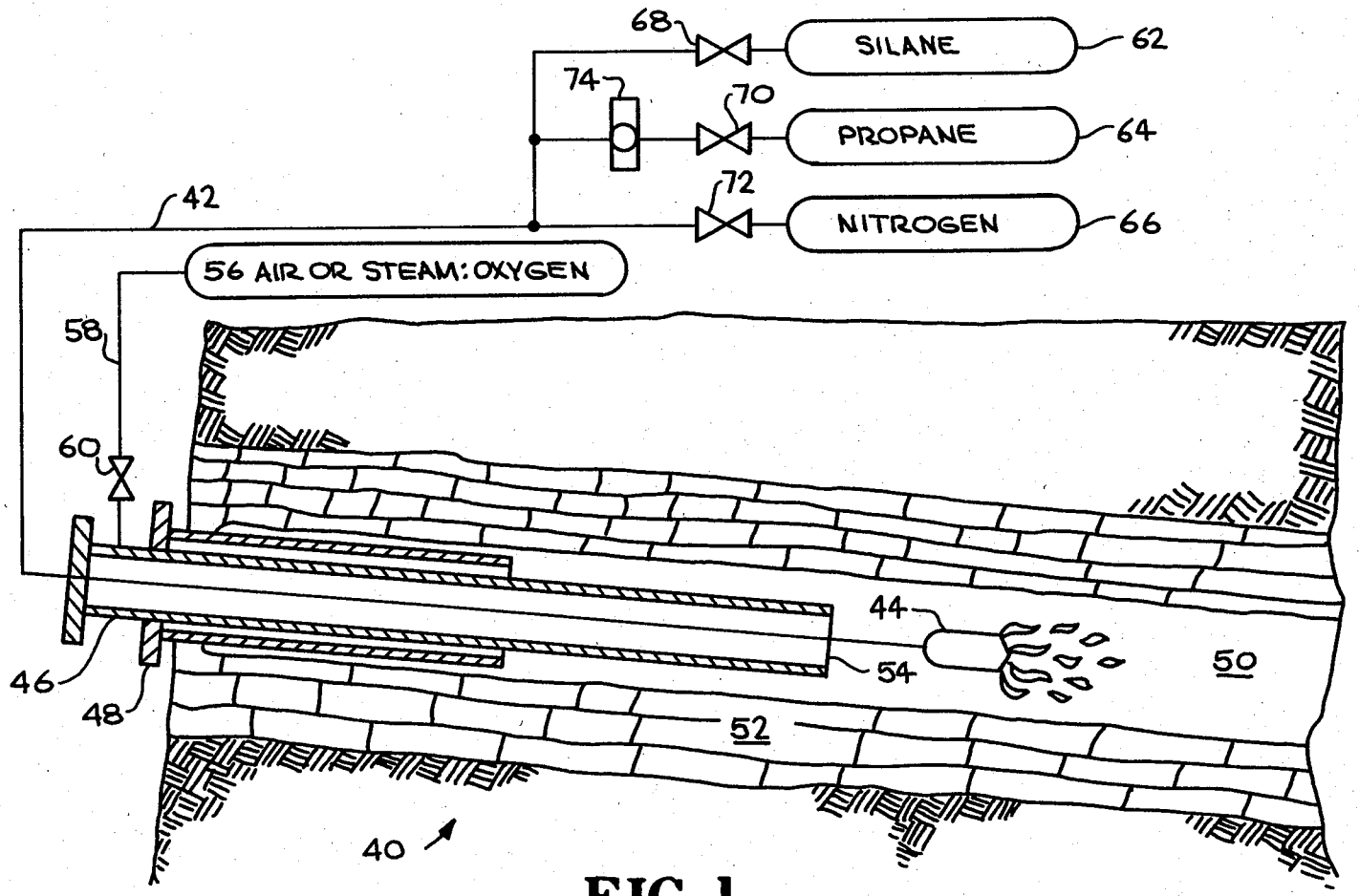
FIG. 1 is a schematic of the silane-propane ignitor/-burner.

The silane-propane ignitor/burner 40 as shown in FIG. 1, comprises a small diameter retractable tube 42 having a burner head 44 attached at the tip. The burner head is not an essential part of the system and can be omitted, if desired. The silane-propane burner 40 is inserted into a steel injection pipe 46 which extends through cement casing 48 into a relatively horizontal borehole 50 through coal seam 52. The burner head 44 is first positioned at the tip 54 of injection pipe 46 to ignite the coal (at a point near the production well). A source 56 of oxygen-steam or air is connected into injection pipe 46 through inlet pipe 58 with valve 60. The retractable tube 42 is connected to sources 62, 64 and 66 of silane, propane and nitrogen, respectively, which are connected through valves 68, 70 and 72, respectively with rotameter 74 connected after valve 70 from propane supply 64 to regulate propane flow. Silane $SiH_4$ is a pyrophoric gas that ignites upon exposure to oxygen or air. Silane or another pyrophoric gas is used to ignite the propane torch. The tube 42 is inserted into the injection pipe 46 to the point where ignition is desired. Proper oxygen or air flow is established in the pipe 46. Tube 42 is purged with nitrogen to drive out any air and a charge of silane is forced through it followed by a fuel gas, preferably propane. When the silane reaches the burner head 44 at the end of tube 42 it contacts the oxygen flowing in injection pipe 46 and bursts into flame. The propane or other fuel gas flowing through the tube 42 after the silane charge then sustains the burn for as long as desired. The burner 40 is used both to initially ignite the coal at the tip 54 of injection pipe 46 and then to burn through sections of the steel pipe 46 to provide new injection points for the coal gasification process.

Figure 2:
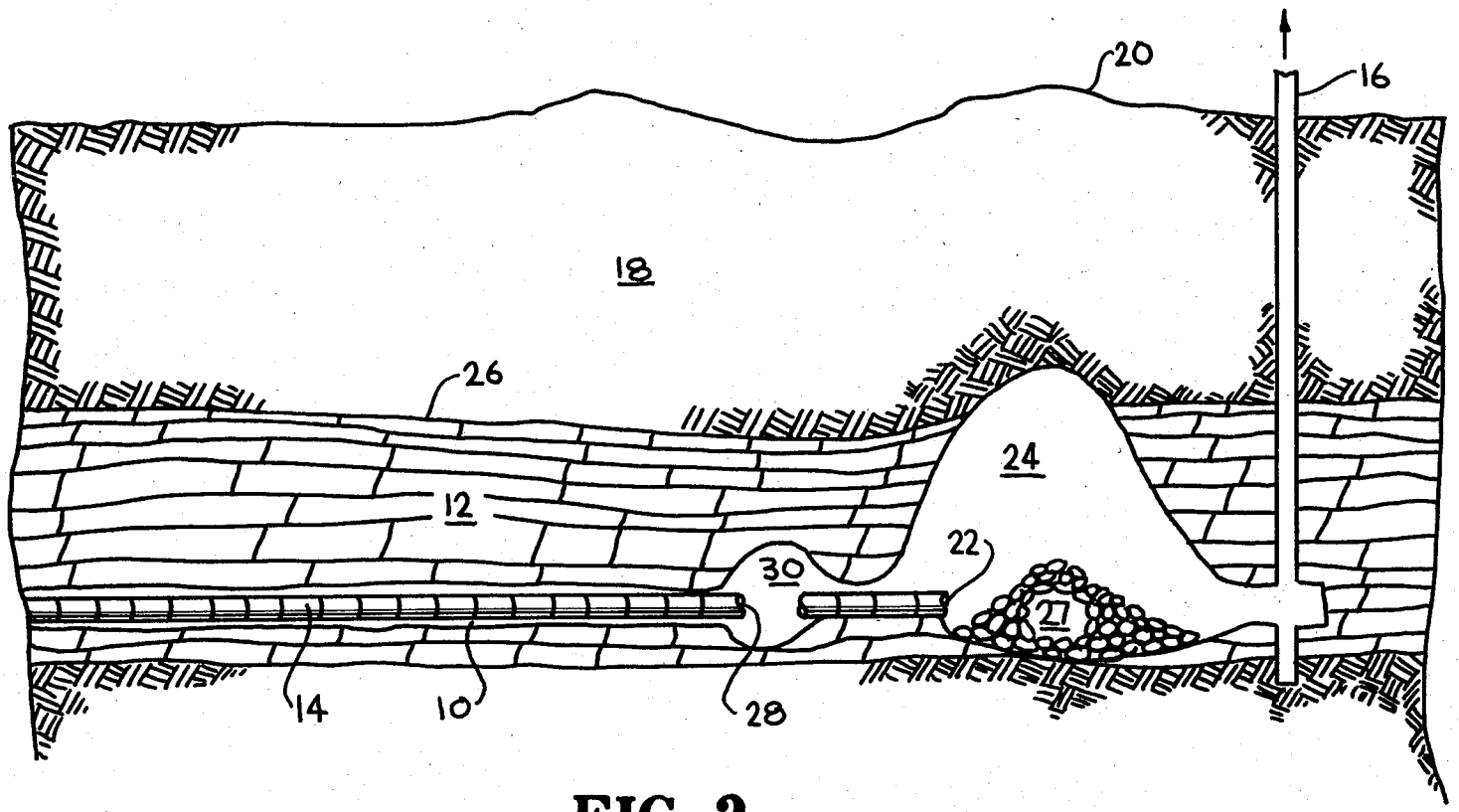
FIG. 2 shows a schematic diagram of a controlled retracting injection point system in an underground coal seam which utilizes the silane-propane burner to move the injection point.

The basic concept of the controlled retracting injection point system, as illustrated in FIG. 2, is to keep the burn zone growing in the upstream direction (with respect to the gas flow in the horizontal injection pipe) by cutting off or perforating the injection pipe at successive new upstream locations which successively become the new injection points. A substantially horizontal borehole 10 is drilled along the bottom of coal seam 12, either from an underground gallery or access well or by directional drilling from the surface. Standard well casing (as shown in FIG. 1) is cemented into the curved or waste part of the borehole to protect against leakage to the surface, and injection pipe 14 is inserted through this casing into the uncased horizontal portion of the borehole 10 which extends as far as drilling ease permits along the bottom of the coal seam 12. The borehole 10 intersects production well 16 which then extends through the coal seam 12 and overburden 18 to the surface 20.

Forward combustion is started at the far end 22 of the injection pipe 14 (near the production well 16). The silane-propane burner (shown in FIG. 1) is placed in the pipe 14 and is utilized to ignite the coal at injection point 22. The gasification process is continued until the burn cavity 24 has grown so large that the product gas quality deteriorates to an unacceptable level which occurs after the burn has reached the seam roof 26 and appreciable roof collapse has occurred filling the cavity 24 with rubble 27.

At this time the silane propane burner is moved down the injection pipe to a new injection point 28 and utilized to cut the injection pipe 14 so that the injected gas (oxygen-steam mixture or air) contacts fresh coal at that point. The injection flow is adjusted to start a new burn zone at the new injection point 28, and forward combustion is reestablished at the normal rate.

Accordingly, a new combustion zone is formed with good contact of oxygen and coal and low heat loss to inert material. Gas quality will again be high until the new cavity 30 approaches the dimensions of the old cavity 24 at which time the silane-propane burner is retracted and utilized again to move the injection point back another increment. This procedure is repeated until the entire length of the horizontal borehole 10 is utilized. Thus, as the cavity grows larger (in FIG. 2) the injection point is moved to the left, step by step, by cutting off the injection pipe using the silane-propane burner, according to the invention. Therefore, the injected gas is always being fed to a zone of the coal seam where unburned coal remains to be gasified.

In operation the silane-propane burner works best if the flow is turned off briefly after the silane reaches the end of the tube and the flow of fuel is slowly begun behind the silane. Both propane and methane can be utilized as fuels. Propane is preferable for pressures up to about 70 psia (5 atm) and methane for higher pressures. The upper pressure limit for silane ignition is about 230 psia (16 atm).

In one embodiment the silane-propane burner comprises a one-half inch stainless steel tube approximately 140 feet long, a burner tip, and a gas supply system. The tube is purged with nitrogen before the ignition sequence. Silane is sent through the tube as the ignition source with propane flowing behind as the sustaining fuel. This system is capable of cutting through three inch diameter stainless pipe in a few minutes. The velocity at which the silane slug emerges from the end of the ignitor tip has some effect. When the propane chase stream is turned on suddenly, failure of ignition can occur. However, when the propane chase stream is turned on slowly by using a needle valve (and a sufficiently large silane charge is used), successful ignition occurs. Accordingly, the ignition procedure generally is to meter the silane to completely fill the length of the burner tube, then wait a few seconds before turning the propane flow on slowly. Propane flows of about one-half of stoichiometric are generally utilized during ignition, with coal ignition times of 7 minutes or less being possible. In a typical pipe cutting operation an oxygen flow of 0.4 mol/s and a propane flow of 0.05 mol/s in about 10 minutes are sufficient for cutting the pipe.

A typical ignition gas mixture is 6.5 percent silane in argon although any concentration above the lower flamability limit of about 1.5 percent in air can be used. An ignition gas mixture below the detonation limit of 8–18 percent is desirable since it prevents detonations which may occur in a pure silane system. Propane and methane are the primary fuels although other fuels can be utilized. Any inert gas, for example, nitrogen can be utilized for the preflush. A one-half inch tube is a preferable size because of its combination of strength and lack of bulkiness. Generally an open tube tip geometry is preferred for simplicity although a special burner tip can also be utilized.

A wide variety of flow rates can be used. In small scale systems, injection pipe 1 inch in diameter, fuel flow rated between 0.4–30 mmol/s and air flow rates up to 300 mmol/s have been tested. In larger systems fuel flow rates of 50 mmol/s and 1 mol/s enriched air (35 percent oxygen) have been used.

The preferred procedure for operation of the silane-propane burner begins with establishing a moderate air flow, 1–2 mol/s, in the well. The burner tube is purged with nitrogen or argon. Enough silane mixture, preferably 6.5 percent silane and argon is injected into the tube to fill 1.1–1.2 tube volumes. The silane flow is then turned off, and after a one minute delay, begin fuel flow at a modest rate, 1–2 mol/s, and increase slowly to the desired flow. Finally, when coal ignition has occurred discontinue fuel flow and retract the burner. The same procedure is followed at various positions to cut the injection pipe to produce new injection points.

Changes and modifications in the specifically described embodiments can be carried out without departing from the scope of the invention which is intended to be limited only by the scope of the appended claims.

We claim:

1. Apparatus for producing a controlled burn in an injection pipe in a horizontal borehole in an underground coal gasification process, comprising:

a small diameter retractable tube which is insertable into the borehole;

a burner tip on the tube which is positioned at the point where the controlled burn is desired to ignite coal or cut the pipe; and gas supply means operatively connected to the tube including a first gas supply means to provide a charge of pyrophoric gas through the tube to the burner tip to contact oxygen containing combustion supporting gas in the pipe and thereby ignite, and a second gas supply means to provide a flow of combustible fuel gas through the tube following the charge of pyrophoric gas to be ignited by the burning pyrophoric gas.

2. The apparatus of claim 1 wherein the gas supply means further includes a third gas supply means to flow an inert purging gas through the tube.

3. The apparatus of claim 2 wherein the gas supply means is a supply of gas selected from nitrogen and argon.

4. The apparatus of claim 1 wherein the first gas supply means is a supply of silane.

5. The apparatus of claim 4 wherein the silane supply is a supply of silane gas mixture with a silane concentration between the lower flamability limit and detonation limit.

6. The apparatus of claim 1 wherein the second gas supply means is a supply of gas selected from propane and methane.

7. The apparatus of claim 1 further including gas flow regulation means operatively connected to the second gas supply means to delay and regulate the flow of fuel gas after the charge of pyrophoric gas.

8. The apparatus of claim 7 wherein the regulator means is a needle valve.

* * * * *